US011701563B1

(12) United States Patent
Leskiff et al.

(10) Patent No.: US 11,701,563 B1
(45) **Date of Patent: *Jul. 18, 2023**

(54) ADJUSTABLE LASER AND SENSOR PAIRED SYSTEM FOR REPLICATING OR CREATING A SWING PATH

(71) Applicant: SWING MASON LLC, Steamboat Springs, CO (US)

(72) Inventors: Walter Leskiff, Steamboat Springs, CO (US); Harri Bronskyy, Toronto (CA)

(73) Assignee: SWING MASON LLC, Steamboat Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/845,271

(22) Filed: Jun. 21, 2022

Related U.S. Application Data

(63) Continuation of application No. 17/110,177, filed on Dec. 2, 2020, now Pat. No. 11,369,854.

(60) Provisional application No. 63/103,205, filed on Jul. 23, 2020, provisional application No. 62/974,401, filed on Dec. 3, 2019.

(51) Int. Cl.
*A63B 69/36* (2006.01)

(52) U.S. Cl.
CPC ..... *A63B 69/3608* (2013.01); *A63B 69/3614* (2013.01); *A63B 69/3629* (2020.08)

(58) Field of Classification Search
CPC ..... A63B 69/3608; A63B 69/3614; A63B 69/3629
USPC ..... 473/220–223, 256, 257, 266, 267, 268, 473/278, 279
See application file for complete search history.

(56) References Cited

U.S. PATENT DOCUMENTS

| | | | |
|---|---|---|---|
| 1,208,995 | A | 12/1916 | Lyon |
| 2,169,407 | A | 8/1939 | Crowley |
| 2,652,251 | A | 9/1953 | Molinar |
| 3,658,344 | A | 4/1972 | Kimble |
| 4,326,718 | A | 4/1982 | Kiehl |
| 4,993,716 | A | 2/1991 | Waller |
| 5,527,037 | A | 6/1996 | Matsumoto |
| 5,685,782 | A | 11/1997 | Lipps |
| 5,759,110 | A | 6/1998 | Seibel |
| 5,938,539 | A | 8/1999 | Hamilton |
| 6,106,408 | A | 8/2000 | Roman |
| 6,488,592 | B1 | 12/2002 | Boatner |
| 6,669,575 | B1 | 12/2003 | Marlette |
| 7,153,216 | B1 | 12/2006 | Pressley |
| 8,696,482 | B1 | 4/2014 | Pedenko |
| 8,840,484 | B2 | 9/2014 | Parke |

(Continued)

*Primary Examiner* — Nini F Legesse
(74) *Attorney, Agent, or Firm* — Polson Intellectual Property Law, PC; Margaret Polson; Christopher Sylvain

(57) ABSTRACT

An adjustable laser-sensor paired system for creating or replicating a desired swing form includes a laser device and a sensor device. The laser device has a laser which emits a laser beam and a mounting device which attaches the laser device to an object. The orientation of the laser is adjustable. The sensor device has an optical linear position sensor for detecting the laser beam of the laser device and a display with LEDs for providing feedback and user interface. With the system and method, one or more checkpoints for the form of a desired swing can be created at a selected point in the swing path, which may then be used as practice reference guides to check whether the user is correctly replicating the desired swing.

19 Claims, 12 Drawing Sheets

(56) References Cited

U.S. PATENT DOCUMENTS

| | | | | |
|---|---|---|---|---|
| 8,961,328 | B1 | 2/2015 | Schmok | |
| 8,974,314 | B2 | 3/2015 | Basile | |
| 9,022,877 | B2 | 5/2015 | Bittner | |
| 9,999,394 | B2 | 6/2018 | Shibuya | |
| 10,463,939 | B2 | 11/2019 | Baker | |
| 11,369,854 | B1 * | 6/2022 | Leskiff | A63B 60/16 |
| 2002/0173368 | A1 * | 11/2002 | Lane | A63B 69/3608 473/215 |
| 2004/0023726 | A1 | 2/2004 | Ritson | |
| 2004/0142773 | A1 * | 7/2004 | Kennedy | A63B 57/50 473/406 |
| 2005/0009616 | A1 | 1/2005 | Dickie | |
| 2013/0260920 | A1 * | 10/2013 | Goldsmith | A63B 57/353 473/404 |
| 2014/0309050 | A1 * | 10/2014 | Nell | H05B 45/20 473/207 |
| 2015/0148145 | A1 | 5/2015 | Jeffrey | |
| 2017/0065868 | A1 | 3/2017 | Taniguchi | |
| 2017/0326427 | A1 | 11/2017 | Smith | |
| 2019/0240556 | A1 * | 8/2019 | Flores | A63B 69/3676 |

* cited by examiner

FIG. 6
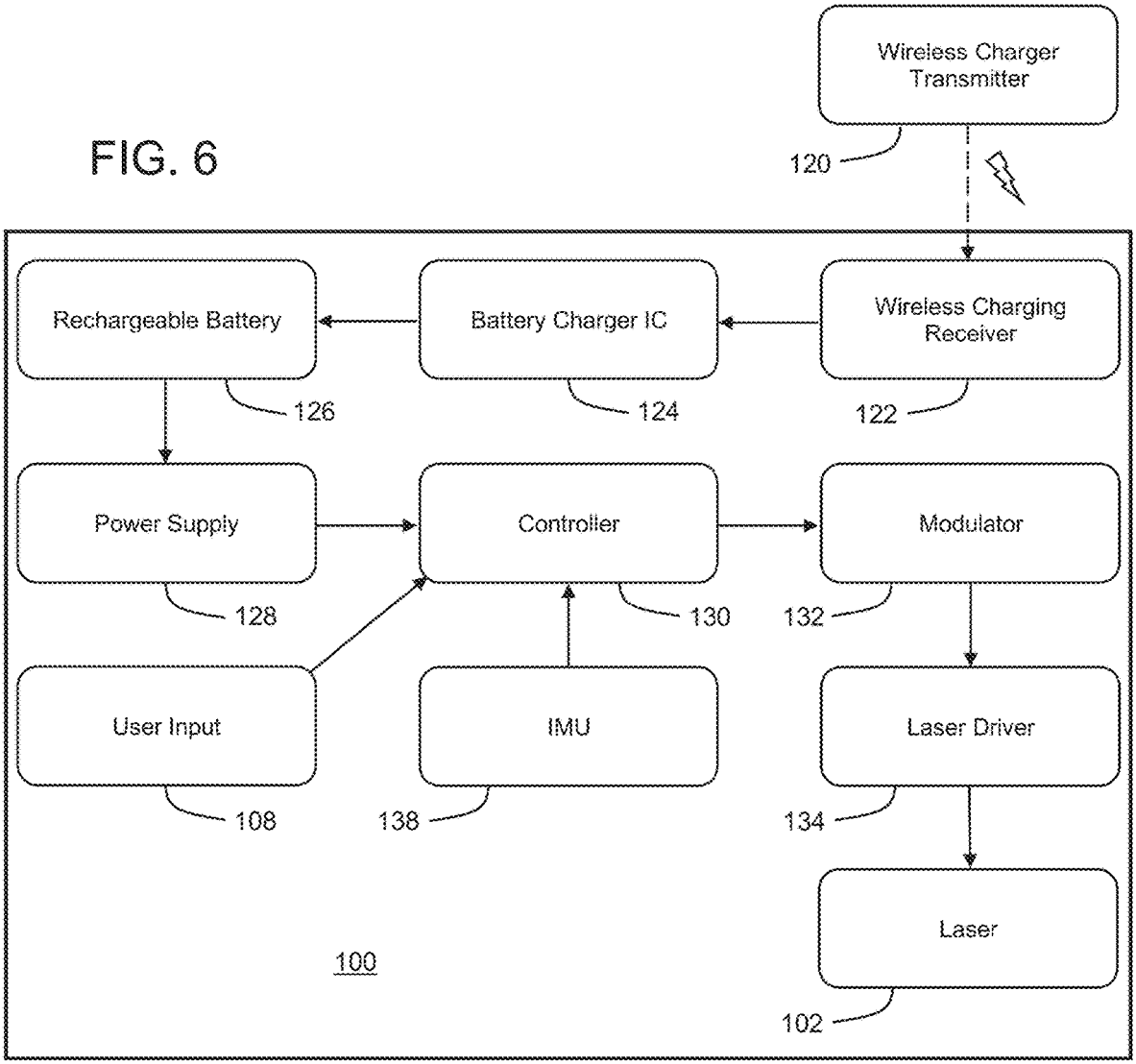
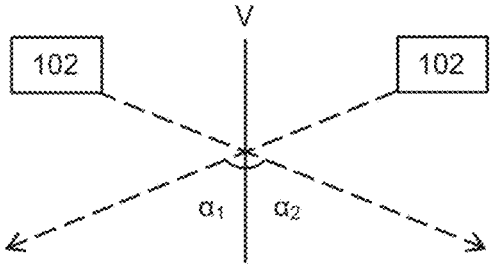
FIG. 7

ADJUSTABLE LASER AND SENSOR PAIRED SYSTEM FOR REPLICATING OR CREATING A SWING PATH

CROSS REFERENCE TO RELATED APPLICATIONS

This application is a continuation of U.S. application Ser. No. 17/110,177 filed Dec. 2, 2020, which claims the benefit of provisional application No. 62/974,401 filed Dec. 3, 2019 and provisional application No. 63/103,205 filed Jul. 23, 2020, which are incorporated by reference herein.

BACKGROUND

Many devices and methods have been developed for practicing a swinging motion such as in golf or other sports. In the golf context, laser-based systems and methods are generally used to track parameters related to the swing output such as trajectory, club face angle, speed, simulated distance, etc. and/or use a fixed configuration of lasers and sensors. While professional training sessions can help identify and correct swing mechanics, users will often relapse to previous tendencies while practicing on their own.

The foregoing examples of the related art and limitations therewith are intended to be illustrative and not exclusive. Other limitations will become apparent to those skilled in the art upon a reading of the specification and a study of the drawings.

SUMMARY

The following embodiments and aspects thereof are described and depicted in conjunction with systems, tools and methods which are meant to be illustrative, not limiting in scope. In various embodiments, one or more problems have been reduced or eliminated, while other embodiments are directed to other improvements.

Proceeding from this background, the present disclosure relates to an adjustable laser-sensor paired system and method for swing practice, such as golf, tennis or baseball for example. One aspect is to create a blueprint of a desired swing by creating one or more checkpoints of the form of the swing motion at a selected point in the swing path. These checkpoints can then serve as reference guides when using the system for swing practice to check whether the user is correctly replicating the desired swing, make adjustments as necessary, and ultimately commit the desired swing form and motion to muscle memory. In other respects, the system and method can be used to monitor the occurrence of undesirable motions during a swing motion, such as the user improperly turning or shifting his or her head for example. A wide variety of training exercises are enabled herewith.

An example laser-sensor paired system comprises a laser device and a sensor device. The laser device has a housing and a laser mounted in the housing. The laser is configured to emit a laser beam. The laser device also has a mounting device rotatably attached to the housing and configured to mount the laser device to an object. The housing is preferably rotatable 360° around an axis of the laser device relative to the mounting device. A position indicator of the laser device with positional reference markings, for example extending around the housing and/or mounting device, can be used to identify a particular orientation of the housing and thus the laser relative to the mounting device. Likewise, the mounting device is preferably rotatable 360° around an axis of the object prior to being secured thereto. Another position indicator with positional reference markings, such as a strip adhesively applied to the object, can be used to identify a particular orientation of the mounting device and thus the laser device relative to the object. The laser device preferably comprises a controller and an inertial measurement unit (IMU). The controller is configured to process signals from the IMU to determine an orientation of the laser beam emitted by the laser and to turn off the laser when the orientation of the laser beam exceeds a predetermined cutoff angle above downward vertical, for example between 70° and 75°. In this way, the risk of direct eye exposure to the laser beam is reduced.

The sensor device has a controller and a display including a laser sensor for detecting the laser beam emitted from the laser device. The laser sensor preferably comprises a linear photodiode array which extends across the display and includes a plurality of photodiode cells configured to convert light to electrical signals. LEDs are preferably provided adjacent each photodiode cell. One or more optical filter films arranged over the linear photodiode array may be used to reduce interference from environmental light. The controller is configured to process signals generated by the linear photodiode array to determine which photodiode cell received a highest amount of laser light when the laser beam of the laser device crosses the laser sensor, and to control operation of the LEDs to indicate the LED adjacent to the photodiode cell which received the highest amount of laser light for user feedback. The sensor device may further comprise a transimpedance amplifier and a peak detector connected between the controller and the laser sensor for pre-processing light detection signals, including with a high pass filter and analog-to-digital (ADC) converter. In some embodiments, LEDs are also arranged around a periphery of the display which are activated when the laser beam is detected by any photosensitive unit of the laser sensor for additional user feedback. The sensor device preferably has precision settings to adjust how many of the photodiode cells are active during use, such as a high difficulty option with a smaller active sensor field and an amateur option with the entire sensor field active for example. In a further development, the sensor device comprises a transceiver for wireless communication with a smartphone. A smartphone app on the phone can then be used to control operation and settings of the sensor device, as well as record and share use data such as practice scores and time.

Depending on the specific training exercise being performed, the laser device is generally attached to the object being swung or to another object, such as an intermediary device which attaches to a clothing article worn by the user. For example, the mounting device of the laser device may be attached to the shaft of an object to be swung by the user, such as a golf club, tennis racquet or baseball bat. In another example, the laser device is attached to a belt mount device having a clip body with slots configured to receive a belt or strap worn by a user, and arms extending from the clip body which carry a shaft for attaching the mounting device of the laser device thereon. In another example, the laser device is attached to a hat mount device having a clip configured to attach to the brim of a hat worn by the user, and an arm extending from the clip which carries a shaft for attaching the mounting device of the laser device thereon. For example, such configurations may be used in exercises for monitoring the occurrence of an undesirable motion, and used even without the sensor device, such as in attaching the hat mount with laser device to a hat worn by the user and focusing the laser beam on a golf ball to check whether the user's head moves while putting the ball. In which case, the system may comprise additional tools like a ball marker for putting practice having visual guides for the stroke motion and desired location of the laser beam through the stroke. For attaching to a shaft-like structure, an example mounting device comprises a ring clamp design, such as a single pin clamp with hinged ring portions and a swing arm closure.

The system may be used with multiple laser devices and/or multiple sensor devices. This allows for tracking various reference points through a single motion. For example, multiple laser devices may be mounted on the object being swung and oriented for different checkpoints of the swing, as well as to the user for monitoring body motions. In which case, the system may be setup with a single sensor device detecting multiple laser beams through the swing, or with multiple sensor devices at different locations detecting the laser beam of one or multiple laser devices through the swing.

An example method, for creating one or more replicable checkpoints for a desired swing of an object by a user, comprises the steps of: mounting a laser device onto a shaft of the object, the laser device comprising a laser and a mounting device which attaches to the shaft of the object, with an orientation of the laser rotatable around an axis of the laser device relative to the mounting device, and an orientation of the mounting device rotatable around the shaft of the object prior to fixing the mounting device on the shaft of the object; positioning a sensor device relative to a stance in which the user will swing the object, the laser sensor comprising an optical linear position sensor; guiding the user into a target swing position for a selected swing checkpoint and adjusting the laser, by changing a position of the laser relative to the mounting device and/or a position of the mounting device on the shaft of the object, such that a laser beam emitted by the laser passes across a center of the optical linear position sensor of the sensor device when the desired swing is performed; and reading, with reference to positional indicator markings on the laser device and the shaft of the object, the position of the laser relative to the mounting device and the position of the mounting device on object at which the laser beam crosses the center of the optical linear position sensor of the sensor device when the desired swing is performed, thereby determining reference values for this selected swing checkpoint. These steps may be repeated to create reference values for additional swing checkpoints of the desired swing. Generally, a positional indicator having positional indicator markings will be applied on the shaft of the object prior to the first use.

In addition to aspects and embodiments described above, further aspects and embodiments will become apparent by reference to the appended drawings, wherein like reference numerals generally designate corresponding elements or structures in the several views.

BRIEF DESCRIPTION OF THE DRAWINGS

The following descriptions utilize example embodiments with reference to the appended figures, wherein:

FIG. 6 is a schematic component diagram of an example laser device;

FIG. 7 shows laser beam inclination angles relative to vertical;

Before explaining depicted embodiments, it is to be understood that the invention is not limited in application to the details of the particular arrangements shown, since the invention is capable of other embodiments. The embodiments and figures disclosed herein are to be considered illustrative rather than limiting. Also, the terminology used herein is for the purposes of description and not limitation.

DETAILED DESCRIPTION

Figure 1:
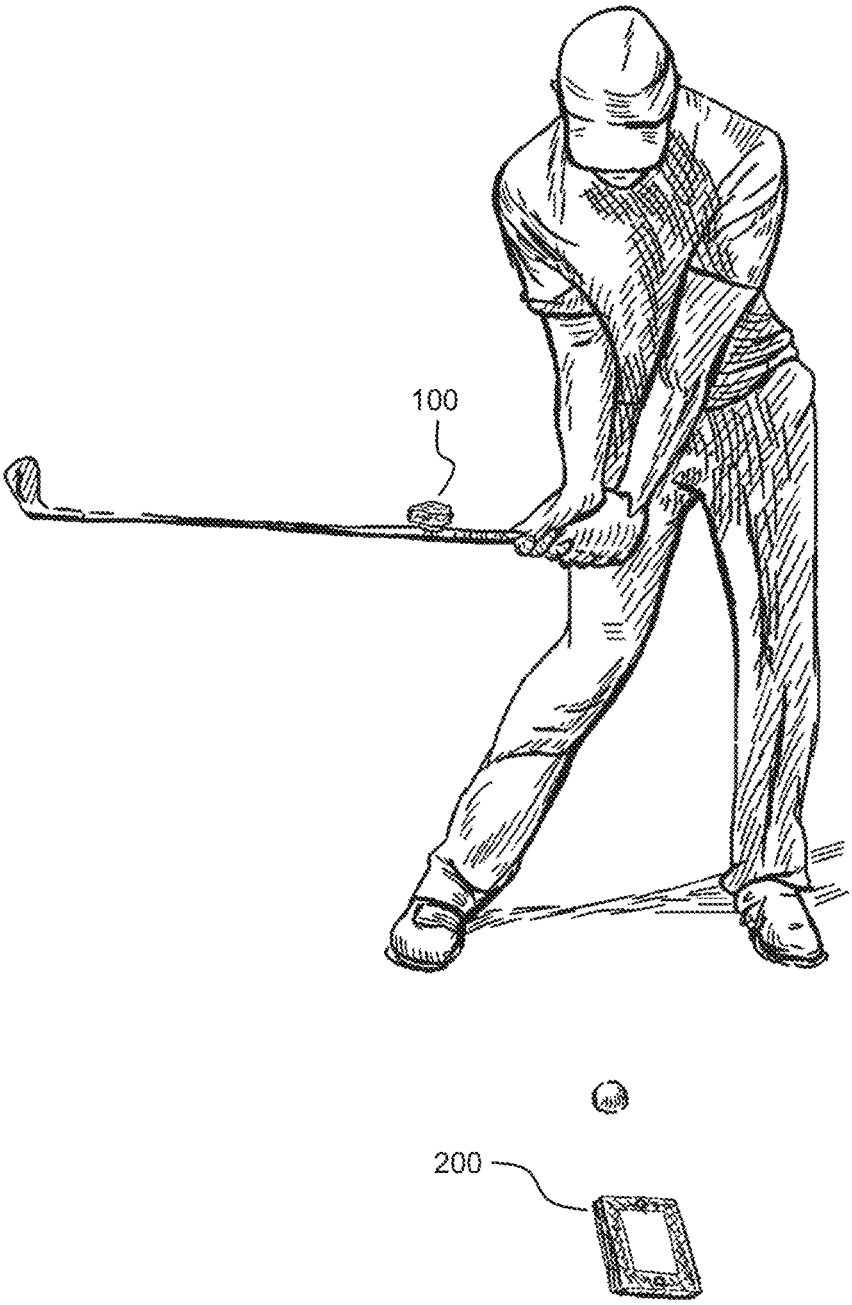
FIG. 1 shows a golfer using an example system according to the present disclosure.
Figure 2:
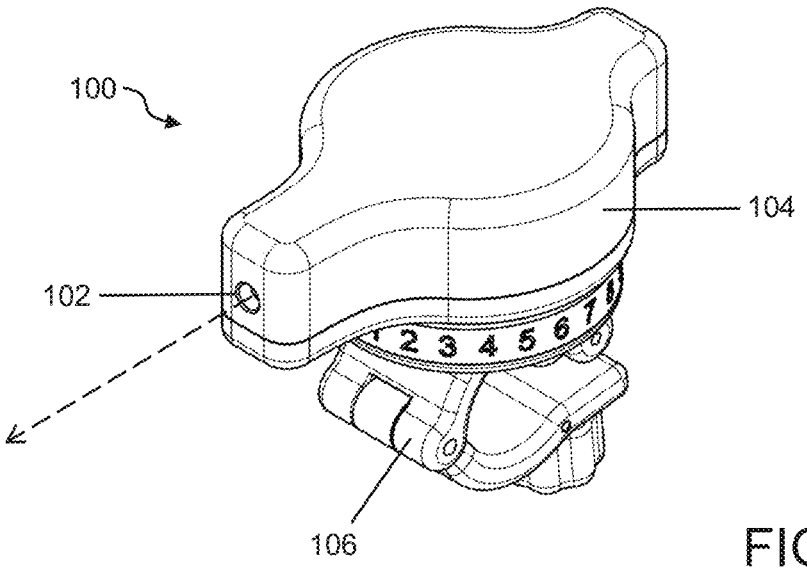
FIGS. 2 and 3 show perspective views of an example laser device of the system.

FIG. 1 shows a user swinging a golf club at a golf ball. The golfer is using a system according to the present disclosure. The system comprises a laser device 100 and a sensor device 200. In this example, the laser device 100 is mounted to the shaft of the club, with the sensor device 200 positioned adjacent the ball opposite the user and outside the swing path of the club.

FIGS. 2-5 show an example laser device 100 of the system. The laser device 100 has a laser 102 mounted in or on a housing 104. The beam emitted by the laser 102 is represented by broken lines in FIG. 2. The laser device 100 also has a mounting device 106 rotatably attached to the housing 104. The mounting device 106 attaches the laser device 100 to an object (e.g. golf club, baseball bat, tennis racquet, training rod, article of clothing, etc.). A button switch 108 is provided on the housing 104 for turning the laser device 200 on and off.

Figure 4:
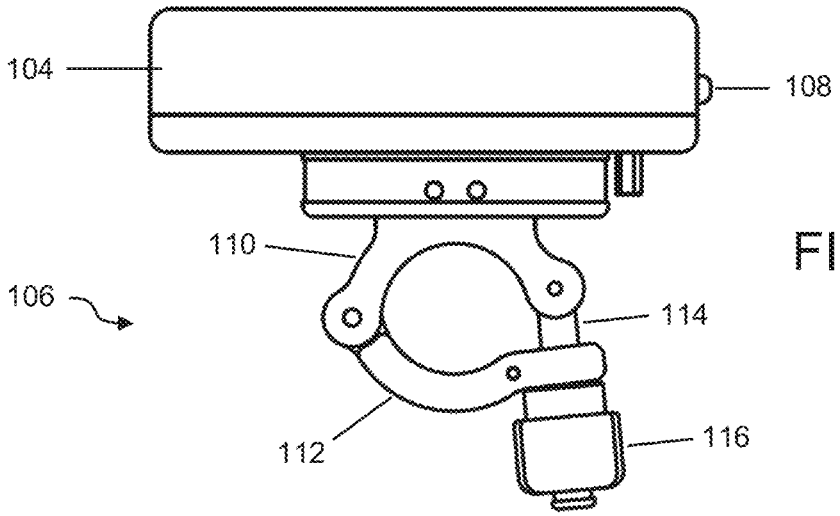
FIGS. 4 and 5 show side views of this laser device.
Figure 5:
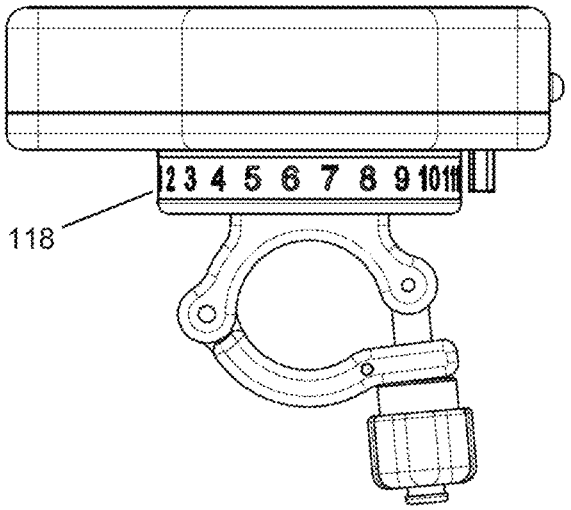

In this example, the mounting device 106 is a single pin clamp configured to mount to the shaft of a golf club or practice rod. The clamp 106 an upper ring portion 110 and a lower ring portion 112 which is pivotably connected to the upper ring portion 110. A swing arm 114 is also pivotably connected to the upper ring portion 110. Opposite its hinged connection to the upper ring portion 110, the lower ring portion 112 has a channel shaped to receive the swing arm shaft 114. Opposite its hinged connection to the upper ring portion 110, the swing arm 114 has a nut or knob 116 which can be tightened against the bottom side of the lower ring portion 112 to clamp the clamp 106 around an object. To open the clamp 106 for mounting or dismounting an object, the swing arm 114 is pivoted out of the channel of the lower ring portion 112 and the lower ring portion 112 is pivoted away from the upper ring portion 110 to allow the object to be inserted therebetween or removed therefrom, with the nut or knob 116 first being adjusted to allow this motion if necessary. Compared to the arrangement of FIG. 4, FIG. 5 shows the clamp 106 with the bottom ring portion 112 further tightened against the upper ring portion 110. Of course, the design of the mounting device 106 may be different depending on the object to which the laser device 100 will be mounted. A variety of options for removably mounting a device to an object are available to those skilled in the art.

Figure 3:
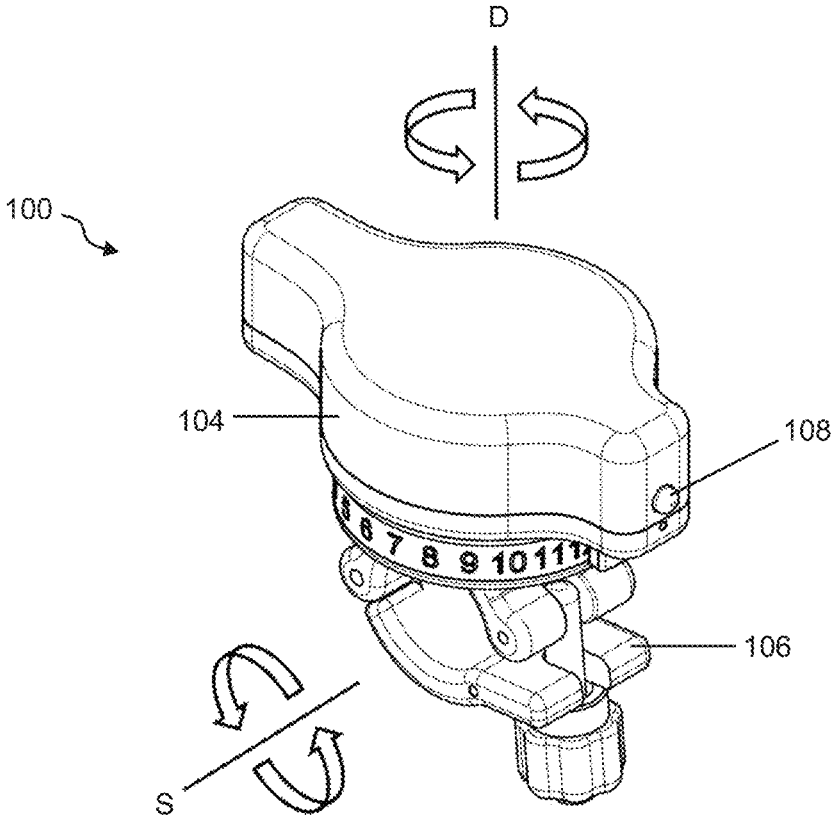

The position and orientation of the laser device 100 on the object can be selected by the user as desired. As seen in FIG. 3, the laser device 100 is rotatable 360° around axis S prior to tightening the mounting device 106 on the object, and the housing 104 carrying the laser 102 is rotatable 360° around axis D with respect to the mounting structure 106 and thus the object. In this way, the beam direction of the laser 102 is adjustable 360° around the axis D of the laser device 100 and 360° around the axis S of the object. As seen in FIG. 5, the upper portion 110 of the ring clamp 106 has a position indicator 118 around its periphery for the selection and recordation of particular positions of the laser beam.

FIG. 6 shows a schematic component diagram of an example laser device 100. This laser device 100 has a receiver 122 (e.g. induction coil, electrode) which couples with a corresponding transmitter 120 of a charger device (not shown) for wireless power transmission therebetween. Integrated circuit 124 transfers the potential produced in the receiver 122 to supply one or more rechargeable batteries 126. In this example, the one or more batteries 126 are two lithium coin batteries). To avoid power supply interruptions caused by vibrations during use, preferably the one or more batteries 126 are positionally biased in their battery holder, such as via a compression spring positive contact pressing in the direction of a rigid plate negative contact for example. The one or more batteries 126 provide power to power supply 128. Preferably, the power supply 128 is provided with reverse polarity protection to protect against damage if the one or more batteries 126 are inserted in the wrong orientation. Preferably, the power supply 128 provides high efficiency conversion with minimal standby current draw to preserve battery charge and life. Controller 130 includes a processor and non-transitory computer readable medium containing instructions that, when executed by the processor, provides for various functions described herein. Controller 130 processes motion signals and controls operation of other components. For example, controller 130 may comprise an ultra-low consumption, high performance ARM core with floating point unit. Pulse width modulator 132 modulates an electrical signal from controller 130 in order to produce a laser beam which is reliably recognizable by the sensor device 200. For example, modulator 132 may generate a signal square wave shape with 50 kHz frequency and 50% duty cycle. Laser driver 134 supplies the laser diode of the laser 102 and limits maximum power output to less than 1 mW in peak value. In this example, the laser 102 comprises a laser diode mounted in a 6 mm diameter brass housing. The laser module is mounted onto PCB secured with epoxy to prevent sliding. The optical system includes a spring and acrylic lens. Fine thread on laser housing helps precisely adjust laser beam focus if needed. The inertial measurement unit (IMU) 138 includes a 3-axis accelerometer and a 3-axis gyroscope which provide motion signals. Controller 130 executes a fusion algorithm to process various motion signals from the motion sensors of the IMU 138 to provide real-time system orientation angles: pitch, roll, yaw. The floating point unit speeds up fusion processing while consuming reasonable current. The pitch angle is correlated to the laser beam inclination angle. The controller 130 will turn off the laser 102 if the direction of the laser beam exceeds a certain threshold above downward vertical. Also with reference to FIG. 7, if the laser beam emitted (represented by broken lines with arrow) by the laser 102 exceeds angle $\alpha$ above the absolute vertical V, the controller 130 terminates the laser 102. In this example, the cutoff angle $\alpha$ is set at or between 70° and 75° which provides good protection, though other angles could be used depending on risk tolerance and anticipated processing delay in view of swing speeds. Such real-time inclination measurement is provided as a safety measure to decrease the probability of direct eye exposure to the laser beam. In use during a swing, the laser beam will activate before and disable after passing the sensor device 200. This activated period through the swing correlates to the combined arc of $\alpha 1$ and $\alpha 2$ in FIG. 7. In a further development, if an erratic movement is registered in any 3 axes, then the controller 130 will switch to a protection mode where the laser 102 is shutdown and disabled for a period of time (e.g. 5 seconds) after the laser device 100 again reaches a steady position. The user can turn the laser device 100 on/off by holding down the button switch 108. In a further development, the controller 130 includes an auto power down function which turns off the laser device 100 if no movement is detected by the IMU 138 for a period of time (e.g. a few minutes) in order to save battery charge. While this example is configured for wireless charging, the laser device 100 could also have a charging port for cable charging or use non-rechargeable or primary cell batteries.

Figure 8:
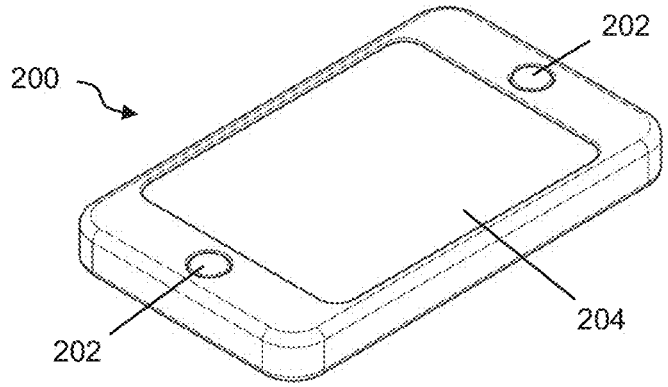
FIG. 8 shows a perspective view of an example sensor device of the system.
Figure 9:
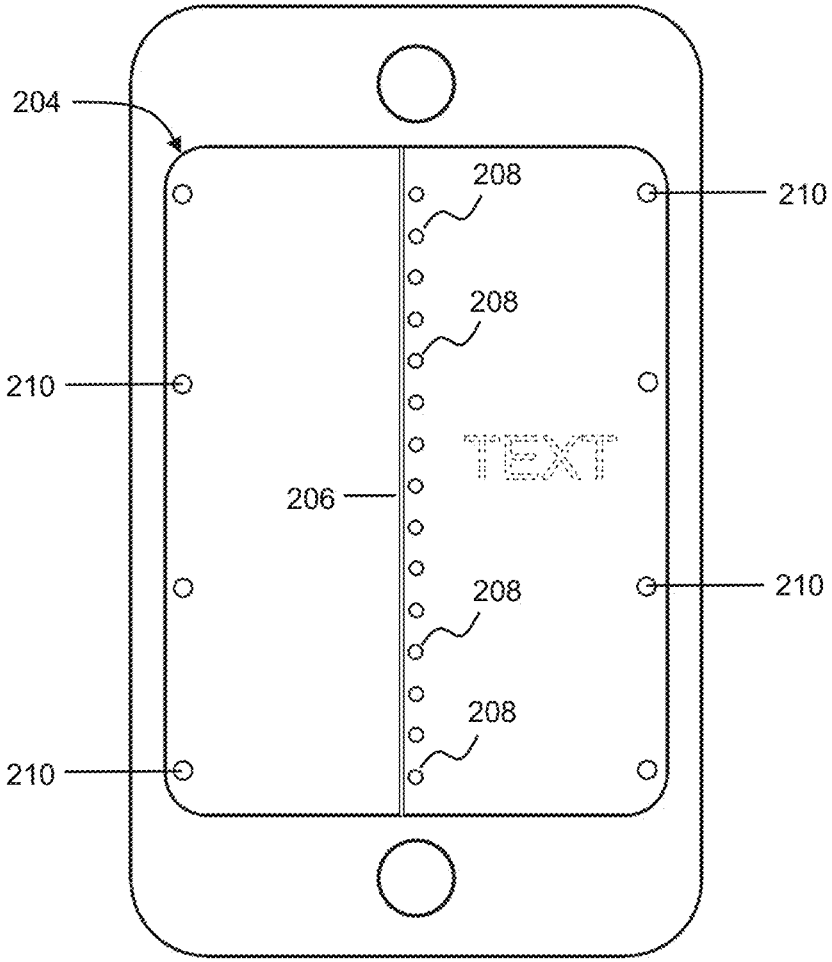
FIG. 9 shows a front view of this sensor device with display elements.
Figure 10:
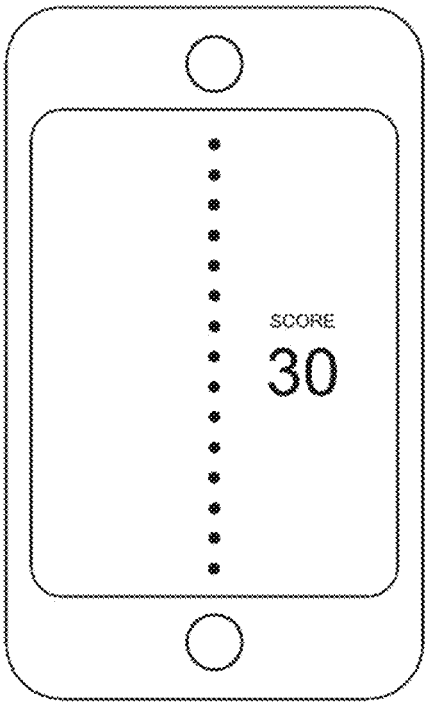
FIGS. 10-13 show examples of the display at various times during use.
Figure 11:
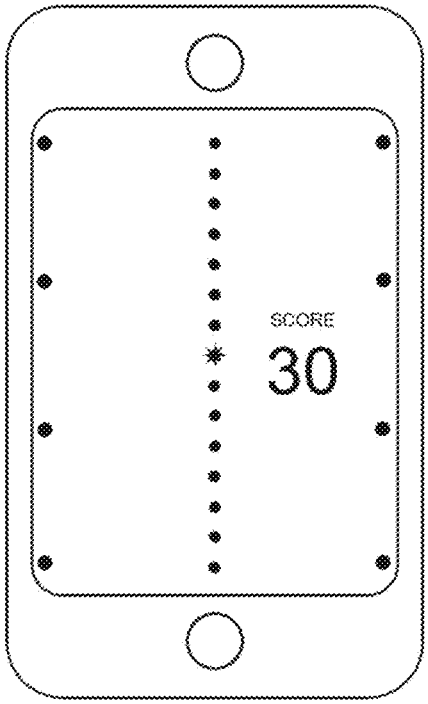
Figure 12:
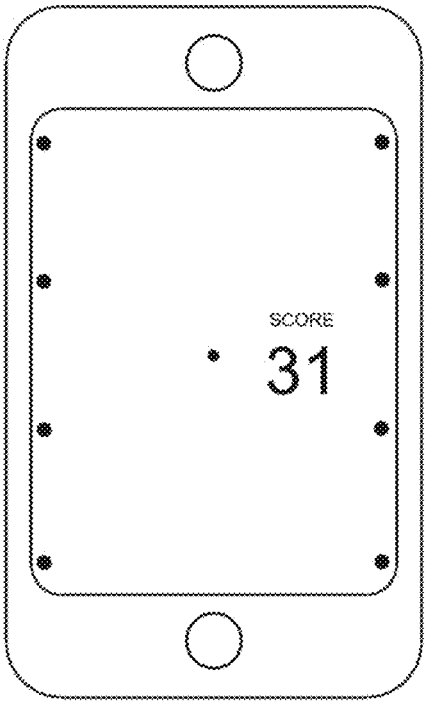
Figure 13:
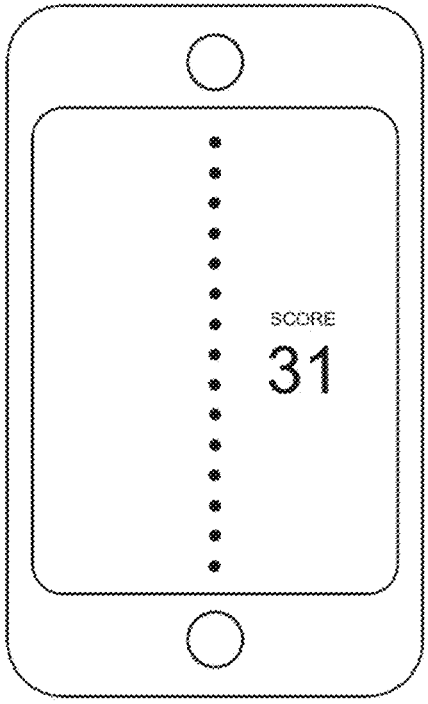

FIG. 8 shows an example sensor device 200 of the system. The sensor device 200 comprises button switches 202 for user input and a display 204. As seen in FIG. 9, a laser sensor 206 and LEDs 208, 210 are provided in the display 204. The display 204 may comprise a relatively basic OLED display with 128×64 white pixel array for displaying text, images, symbols and animations (e.g. logo, greeting sequence, etc.). Of course, more powerful displays may be selected for higher quality graphic capabilities in view of cost, processing and power requirements. The laser sensor 206 is an optical linear position sensor with photodiode array. In this example, the sensor 206 comprises 15 photodiode cells which convert light into electrical signal. Therefore, the photodiodes detect when the laser beam emitted from the laser 102 crosses. To decrease false positives, one or more optical filter films are provided over the photodiode array to decrease the intensity of ambient visible, UV and IR light below an operational signal threshold. LEDs 208 are provided next to each photodiode cell of the laser sensor 206 and act as tracking LEDs 208 to indicate the location of the laser beam's path in crossing the photodiode array. Therefore, in this example there are 15 track LEDs 208 corresponding to each of the photodiode cells. LEDs 210 are optionally provided around the periphery of the display 204. These 8 LEDs 210 are activated when the laser sensor 206 detects the laser beam regardless of location. For example, in FIG. 10 the laser sensor 206 is waiting for the user's next swing and all of the LEDs 208 are illuminated. In FIG. 11, the laser beam has struck the central LED 208 and the LEDs 210 have lit up to indicate the laser beam hit. In FIG. 12, only the central LED 208 remains illuminated and the score text has changed from 30 to 31 points to reflect the positive swing. In FIG. 13, the display 204 has returned to the state of FIG. 12 for the user's next swing.

Figure 14:
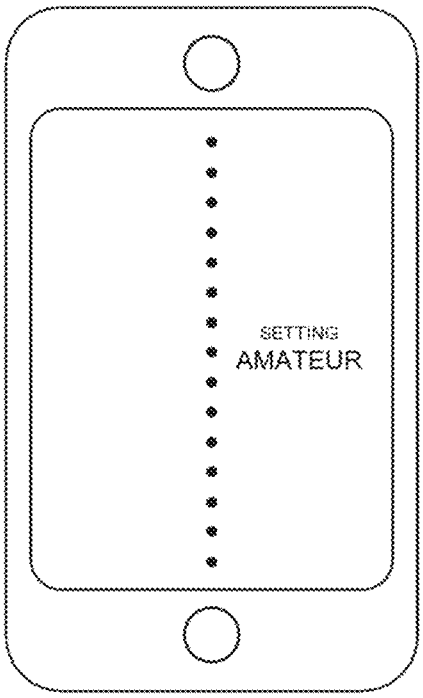
FIGS. 14 and 15 show different precision settings of the sensor device.
Figure 15:
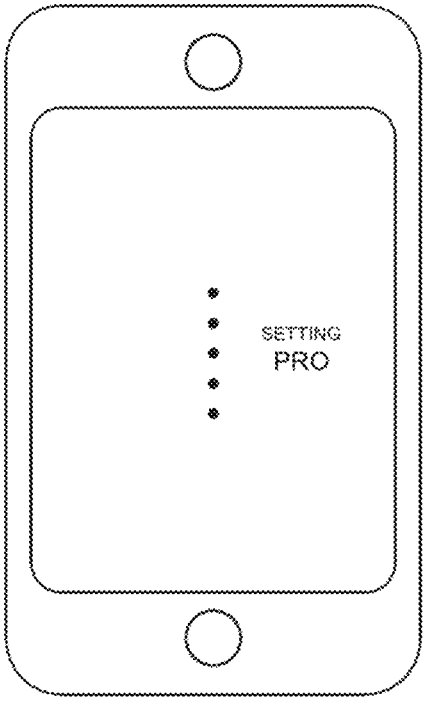

The sensor device 200 may have different precision settings which can be adjusted for the skill of the user. For example, FIG. 14 shows a setting where all of the photodiode cells of the optical linear position sensor 206 are active, and therefore all the track LEDs 208 are illuminated, which may be preferable for amateurs. FIG. 15 shows a setting where the active sensor field only includes the middle 5 photodiode cells of the optical linear position sensor 206, and therefore only the corresponding middle track LEDs 208 are illuminated, which may be preferable for professionals. Of course, various other settings are possible by modifying the number of total and active cells of the photodiode array.

Figure 16:
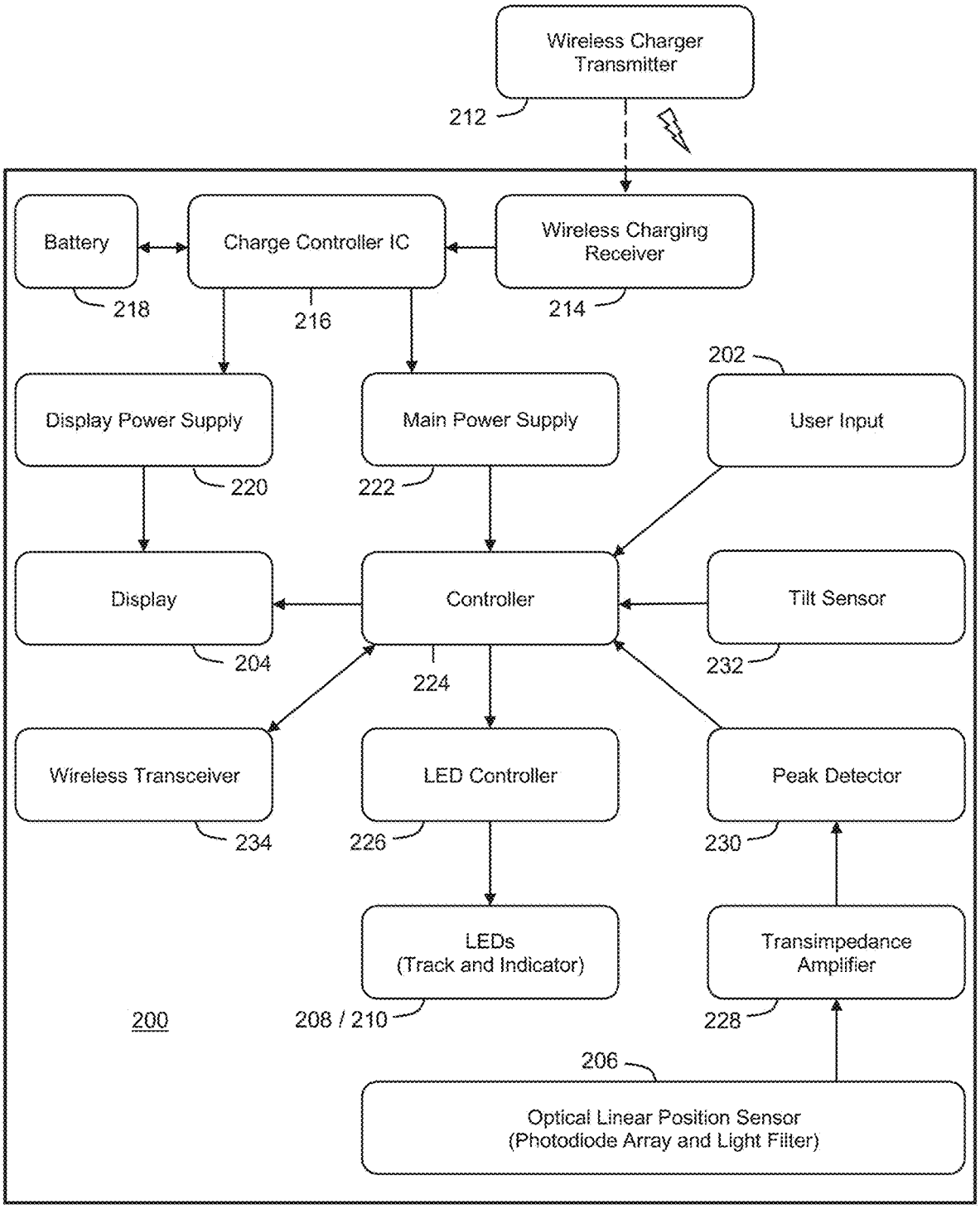
FIG. 16 is a schematic component diagram of an example sensor device.

FIG. 16 shows a schematic component diagram of an example sensor device 200. This sensor device 200 has a receiver 214 (e.g. induction coil, electrode) built into the back side opposite the display 204 which couples with a corresponding transmitter 212 of a charger device (not shown) for wireless power transmission therebetween. The battery charging circuit 216 accepts voltage input from the receiver 214 and charges the one or more batteries 218. In this example, the one or more batteries 218 is a one cell Li-Poly battery. The charge controller circuit 216 also supplies power from the one or more batteries 218. The circuit 216 has two low dropout (LDO) voltage regulators. One regulator with low quiescent current supplies the controller 224 and other components. The other regulator supplies current to display 204 with enable/disable function to save power when not in use. Controller 224 includes a processor and non-transitory computer readable medium containing instructions that, when executed by the processor, provides for various functions described herein. The brightness of the display 204 can be adjusted by command from the controller 224, for example in response to user input or ambient light levels. The controller 224 also controls via LED luminance controller 226 the activity and brightness of the LEDs 208, 210. As discussed above, LEDs 208 are each placed next to one of the photosensitive cells to display the target zone and to indicate position where the laser beam hit. LEDs indicate when the laser beam has hit any photosensitive cell in the sensor field. The laser sensor 206 includes the linear photodiode array and preferably optical filter films to keep ambient light under operational thresholds, particularly in the case of outdoor daytime use. Preferably, these films decrease the intensity of visible, UV and IR light at equal or approximately equal ratios. The transimpedance amplifier 228 further uses a high-pass filter to filter out ambient light signals and amplifies the laser beam detection signals. The analog signals are processed by peak detector 230 and converted via ADC to digital signals. The controller 224 processes the digital signals to determine the position of the photosensitive cell which received the highest amount of laser light, and controls LED activity in accordance with this determination. The sensor device 230 optionally includes a tilt sensor 232 such as a 3-axis accelerometer to detect device motion, which can be used to adjust display (e.g. increase brightness when the sensor device 200 is picked up by the user). Button switches 202 as user input can be used for interface navigation (e.g. mode, precision setting, etc.) and manual on/off control. Optional wireless transceiver 234 may be provided for communication (e.g. via Bluetooth protocol) with a smartphone application. For example, the application may record data from each session to allow users to conveniently review and share historical scores and progression on their phones. While this example is configured for wireless charging, the sensor device 200 could also have a charging port for cable charging or use non-rechargeable or primary cell batteries.

Figure 17:
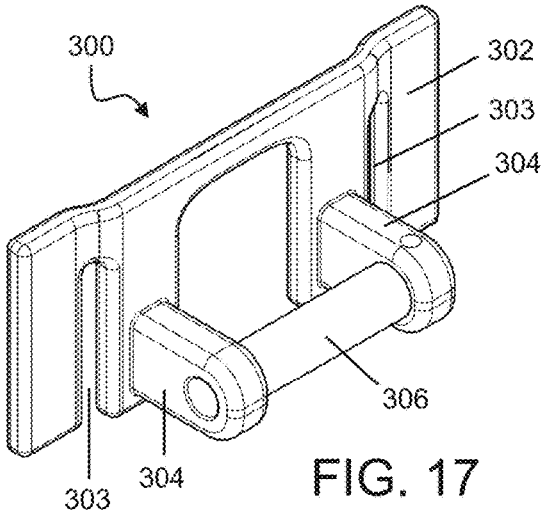
FIG. 17 shows a perspective view of an example belt mount for use with the system.
Figure 18:
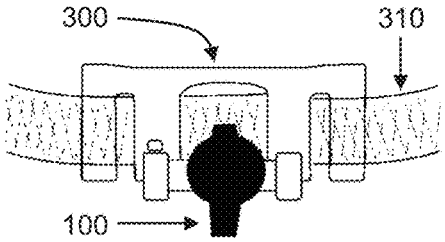
FIG. 18 shows a front view of the belt mount with laser device on a belt.
Figure 19:
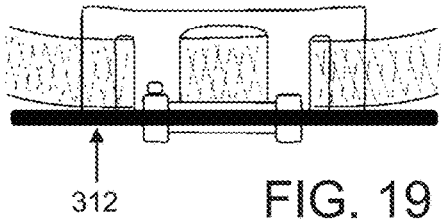
FIG. 19 shows a front view of the belt mount with training rod on a belt.
Figure 20:
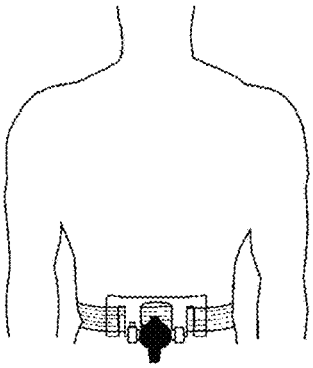
FIG. 20 shows the arrangement of FIG. 18 being worn at the waist.
Figure 21:
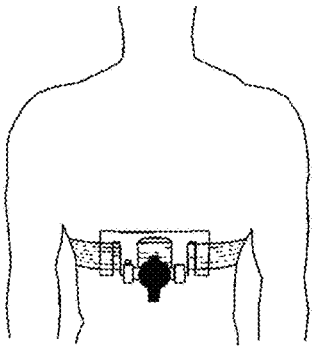
FIG. 21 shows the arrangement of FIG. 18 being worn at the chest.
Figure 22:
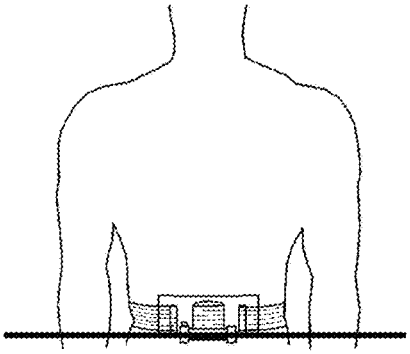
FIG. 22 shows the arrangement of FIG. 19 being worn at the waist.
Figure 23:
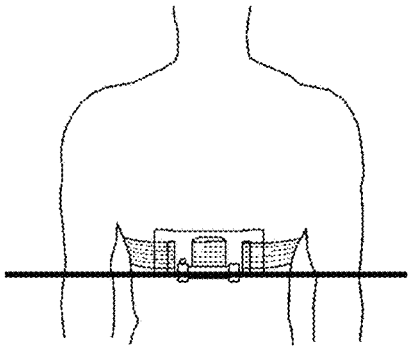
FIG. 23 shows the arrangement of FIG. 19 being worn at the chest.

FIG. 17 shows a belt mount 300 for use with the laser-sensor system. The belt mount 300 comprises a clip body 302 with belt attachment slots 303. Arms 304 extend from the clip body 302 and carry a hollow mounting shaft 306. The laser device of the system can be mounted onto the shaft 306 in the same manner as a golf club shaft. FIG. 18 shows the belt mount 300 attached to a belt 310 with the laser device 100 mounted to the shaft 306. In FIG. 19, a training rod 312 is mounted within the hollow shaft 306. The laser device or devices 100 may be mounted on the training rod 312 itself for use with the sensor device or devices 200. FIGS. 20-23 further illustrate that the belt 310 with belt mount 300 can be worn at different locations by the user, for example at the waist or across the chest, for performing different practice exercises. Various applications are thus available related to body alignment with this configuration.

Figure 24:
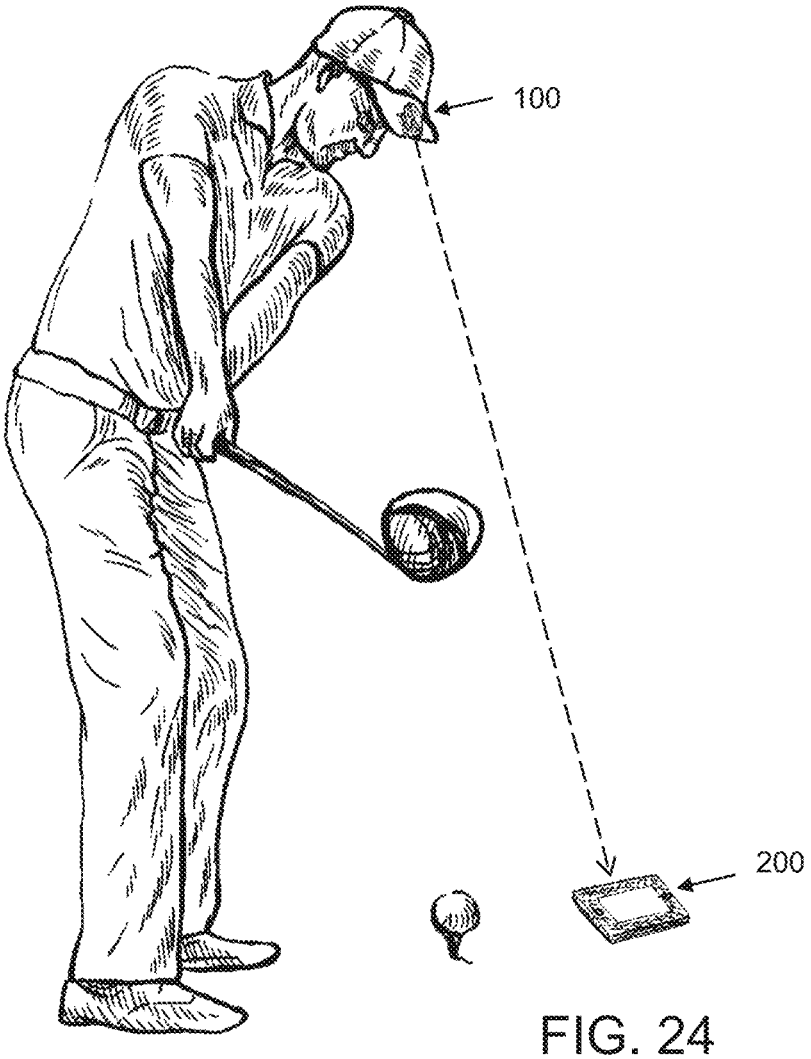
FIG. 24 shows a golfer using the system with the laser device attached to a hat.
Figure 25:
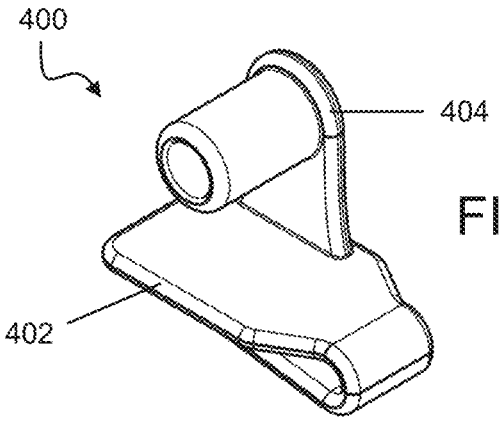
FIG. 25 shows a perspective view of an example hat mount for using the system as shown in FIG. 24.

FIG. 24 shows a user swinging a golf club at a golf ball using the system comprising the laser device 100 and sensor device 200 as in FIG. 1, except with the laser device 100 mounted to a hat worn by the user. In this exercise, the user is trying to keep the laser pointer focused at the same position through the backswing, since at least in conventional theory the head should stay still through the backswing. With a righthanded swing, there is a tendency to shift or turn the head to the right during the backswing. By positioning the laser beam to the left of the sensor device 200 for a righthand swing, the laser sensor 206 will detect whether the laser beam crosses during the backswing, meaning the user as shifted or turned the head to the right. The opposite applies for a left-handed golfer. Therefore in this exercise, the user is trying to avoid triggering the sensor device 200 with the laser beam of the laser device 200. FIG. 25 shows an example hat mount 400 for use with the laser-sensor system. The hat mount 400 comprises a clip 402 which attaches to the brim of the hat. An arm with mounting shaft 404 extends from clip body 402. The laser device of the system can be mounted onto the shaft 404 in the same manner as a golf club shaft or the belt mount 300.

The mounting devices 300, 400 provide utility and benefits independent of the laser-sensor system. As described above, the hollow shaft 306 of the belt mount 300 may be used to hold a training rod 312 to practice body alignment and form during the swing motion, with or without the laser device 100. The same applies to the hat mount 400, for example where the shaft 404 has a hollow construction to hold a training rod for practicing head alignment and form.

Figure 26:
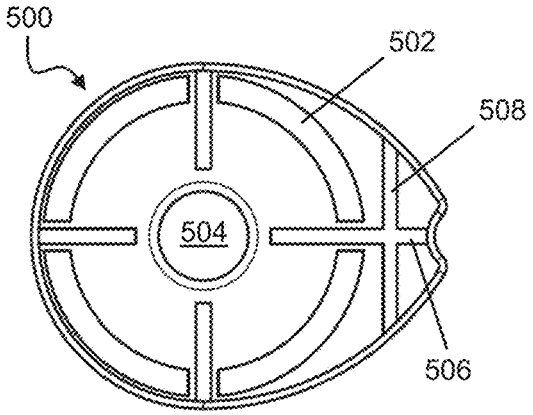
FIG. 26 shows a top view of an example ball marker for use with the system.
Figure 27:
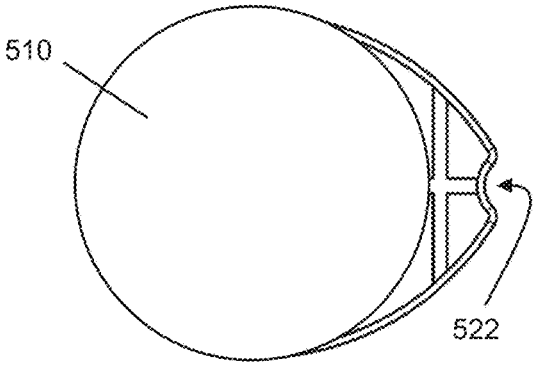
FIG. 27 shows a golf ball placed on the ball marker.
Figure 28:
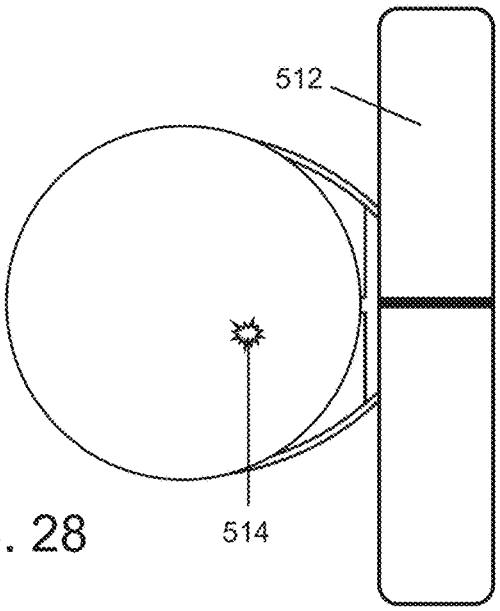
FIG. 28 shows the ball marker with a putter blade and laser point setup.

FIG. 26 shows a ball marker 500 for putting practice using the laser-sensor system. The ball marker 500 comprises a circular placement indicator 502. At the center of the indicator 502, the ball marker 500 has a hole 504 for placement of a golf ball. On its side configured to face in the direction of the user's backstroke, the ball marker 500 comprises a target line indicator 506 which is perpendicular to a club face line indicator 508. In FIG. 27, a golf ball 510 has been placed on the ball marker 500 and is nested in the hole 504. For putting approach, the user will close his or her dominant eye and adjust their stance such that the ball placement indicator is not visible with the non-dominant eye. In FIG. 28, a putter 512 is brought into position such that its blade face is parallel to the line indicator 508 and centered with respect to the line indicator 506. The laser beam 514 being emitted from the laser device 100, which may be mounted to the user's hat via the hat mount 400 for example, is located on the ball. As a practice tool, the laser beam 514 should remain within the circular indicator 502 after the user strikes the ball, since at least in conventional theory the user should strive to keep his or her head still while putting.

Figure 29:
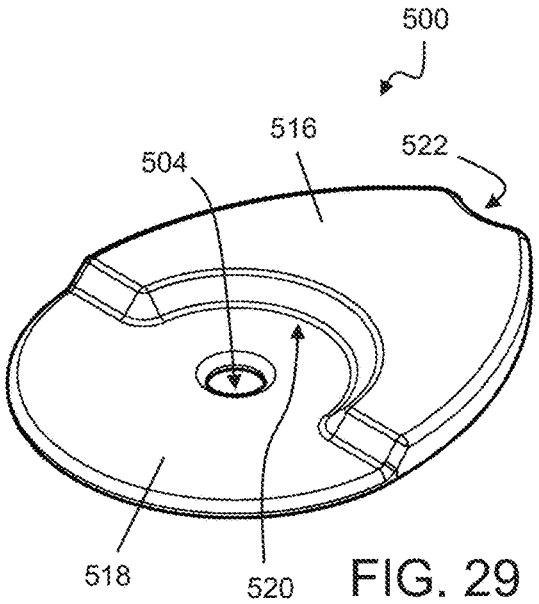
FIG. 29 shows a perspective view of a ball marker having sections of different thickness, with guide markings omitted for clarity.
Figure 30:
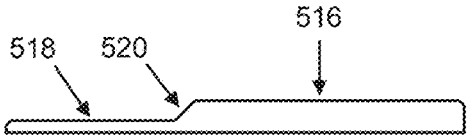
FIG. 30 shows a side view of the ball marker of FIG. 29.

FIGS. 29 and 30 show a further development of the ball marker 500. Guide markings 502, 506, 508 are omitted for illustration here. This ball marker 500 has two sections of different thickness. A thicker section 516 is provided on the side of the ball marker 500 with the line indicators 506, 508. A thinner section 518 is provided on the side of the ball marker 500 with the hole 504. The interface 520 between the sections 516, 518 is shaped to receive the ball 510 at the location of the hole 504, such that the interface 520 is curved in the area surrounding the hole 504 to increase the extension of the thinner section 518 into this area. In making a putt stroke, the user must lift up the putter 512 enough to clear the thicker section 516 or the putter 512 will contact the ball marker 500 before the ball 510. The thinner section 518 is provided to allow the ball 510 to roll off the ball marker 500 when the user successfully hits the ball 510. An example thickness of section 516 is about 5 mm and an example thickness of section 518 is about 1.2 mm. This wedged-shape profile design helps train users to contact the ball with the putter 512 lifted off the ground at an effective height for contacting the sweet spot on the ball, which avoids bouncing the putter head off the ground or sliding the putter head along the ground during the putting stroke as well as topping the ball with the bottom of the putter head. Such common putting problems can affect speed, alignment and contact in striking the ball.

Accordingly, the ball marker 500 provides utility and benefits independent of the laser-sensor system. As described above, the ball marker 500 can be used to practice stance setup, in that the user places the ball 510 on the marker 500, closes his or her dominant eye, and adjusts his or her stance so that the ball 510 covers or eclipses the circular indicator 502 from the viewpoint of the open non-dominant eye, at which point the user is in the preferred position and can open his or her dominant eye to perform the putt. In this stance position, the non-dominant eye still sees the peripheral extension of the target line indicator 506 and the dominant eye is positioned to be able to see the ball contact. Likewise, the ball marker 500 with sections of different thickness described above can be used to practice a lifted putting stroke at an effective height above the ground for making solid ball contact, which exercise does not require the laser-sensor system. Another utility relates to use during an actual round of golf. The ball marker 500 may be used to mark a ball on the green. In placing the ball marker 500 on the green, the user can arrange the ball marker 500 such that the target line indicator 506 is directionally aligned with the target putting path of the ball 510 on the green. Preferably, the user will have drawn a straight line on the ball 510 being played. Then in placing the ball 510, the user can align the line of the ball 510 with the target line indicator 506 of the ball marker 500 such that both lines form a continuous straight line. After picking up the ball marker 500, the user is ready to putt the ball 510 with its line oriented in the target putting path. In setting the putter 510 relative to the ball 510, the user may further use the perpendicular line indicator 508 of the ball marker 500 as a guide to ensure the putter face is square to the target putting path. For adjusting the ball marker 500 into the desired directional orientation when marking the ball 510, the ball marker 500 may have a curved notch 522 which is placed adjacent the ball 510, such that the notch 522 indicates the position of the ball 510 after the ball marker 500 is rotated into the desired directional orientation (see FIGS. 27 and 29).

Figure 31:
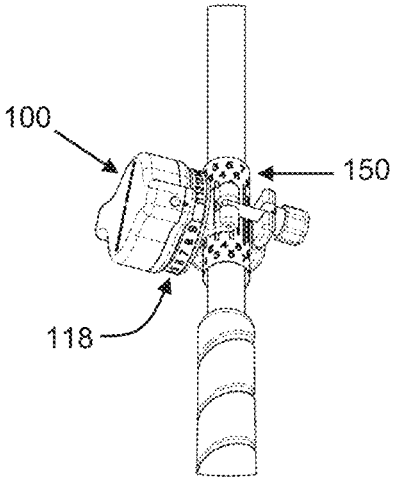
FIG. 31 shows a laser device mounted to a golf club shaft with axial position indicator.
Figure 32:
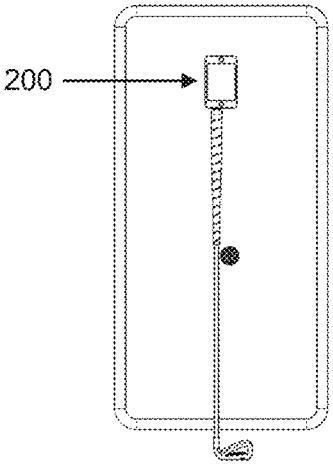
FIG. 32 shows a sensor device being setup relative to a golf ball.
Figure 33:
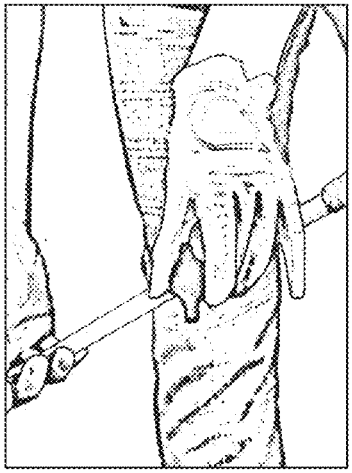
FIG. 33 shows a person adjusting the laser device of FIG. 31 while the golf club is being held in position by the user at a selected swing checkpoint.
Figure 34:
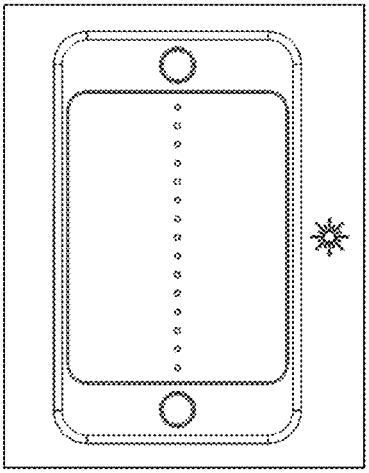
FIG. 34 shows the emitted laser beam point on the ground adjacent the sensor device of FIG. 32.
Figure 35:
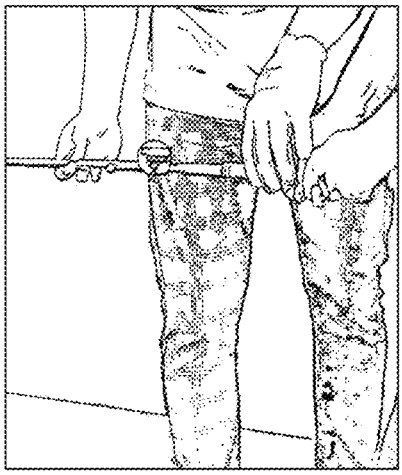
FIGS. 35 and 36 show additional swing checkpoints being configured.
Figure 36:
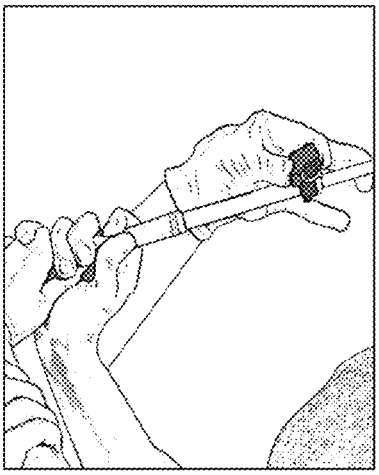

An example method for creating a swing blueprint using the system is now described. As preliminary setup, a position indicator is applied to the object on which the laser device will be mounted (e.g. golf club, practice rod, belt mount, etc.). This position indicator provides reference points for the mounting orientation of the laser device on the object in a similar manner that the position indicator 118 of the laser device 100 provides reference points for the laser direction. FIG. 31 shows an example position indicator 150 applied on the shaft of a golf club with the laser device 100 mounted thereon. The sensor device is positioned relative to the stance in which the user will swing. The sensor device should be placed at a consistent location relative to the user in a replicable manner for purposes of subsequent practice sessions. FIG. 32 shows an example setup where the sensor device 200 is positioned a club grip length from the golf ball. With the laser device 100 on the object and the sensor device 200 in position, the user is guided or moves into a target swing position for a selected swing checkpoint and holds the form of this position, while another person (e.g. golf instructor) adjusts the position of the laser 102 by rotating the laser device housing 104 around axis D and/or rotating the entire laser device 100 around axis S as necessary (see FIG. 33) so that the emitted laser beam point on the ground is at the center of the sensor device 200 or adjacent to the center of the sensor device 200 on the backswing side for a backswing checkpoint (see FIG. 34). For a forward-swing checkpoint, the laser beam would be positioned to be at the center of the sensor device 200 or adjacent to the center of the sensor device 200 on the follow-through side. This swing checkpoint is then recorded by reading the axis coordinates from laser device and object indicators 118, 150. This process may be repeated for as many different swing checkpoints as desired. FIGS. 35 and 36 show additional example checkpoints being calibrated. The user can then practice replicating and developing muscle memory for his or her target swing on the basis of these saved swing checkpoints using the laser-sensor system.

The laser-sensor system and method may comprise more than one laser device 100 and more than one sensor device 200. For example, multiple laser devices 100 may be mounted on the swung object (e.g. golf club, baseball bat, tennis racquet, etc.) and/or articles worn by a user (e.g. belt, hat, training rod, etc.) in order to assess and track multiple swing checkpoints during a single swing motion by the user. In this case, a single sensor device 200 may detect and process more than one laser beam emitted from more than one laser device 100 and/or multiple sensor devices 200 may be setup to detect multiple laser beams through the single swing motion.

While a number of aspects and embodiments have been discussed herein, those skilled in the art will recognize numerous modifications, permutations, additions, combinations and sub-combinations therefor, without same needing to be specifically explained in the context of this disclosure. The appended claims should therefore be interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown or described, or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are hereby incorporated into this disclosure. When a Markush group or other grouping is used herein, all individual members of the group and all combinations and sub-combinations possible of the group are hereby individually included in this disclosure.

In general, the terms and phrases used herein have their art-recognized meaning, which can be found by reference to standard texts, references and contexts known to those skilled in the art. The above definitions are provided to clarify their specific use in the context of the invention.

The invention claimed is:

1. A system for practicing a swing motion, comprising:

a laser device comprising a housing, a laser configured to emit a laser beam mounted in the housing, and a mounting device configured to mount the laser device to a shaft of an object, wherein:

the mounting device is rotatable 360° around the shaft of the object prior to being secured thereto, and wherein the housing is rotatable 360° around an axis of the laser device relative to the mounting device, with a position indicator of the laser device having position reference markings for indicating specific positions of the housing and thus the laser relative to the mounting device, the laser device further comprises a controller and an inertial measurement unit (IMU), the controller configured to process signals from the IMU to determine an orientation of the laser beam emitted by the laser and to turn off the laser when the orientation of the laser beam exceeds a predetermined cutoff angle above downward vertical, and the predetermined cutoff angle is between 70° and 75°, the mounting device of the laser device comprises a ring clamp, and the ring clamp is a single pin clamp with hinged ring portions and a swing arm closure, and the object is a golf club, tennis racquet or baseball bat to be swung by a user;

a belt mount device comprising a clip body and two arms extending outward from the clip body, wherein the clip body has two attachment slots configured to receive a strap worn by a user, the attachment slots fully extend through the clip body in a horizontal direction, and the attachment slots partially extend through the clip body in a vertical direction beginning from a bottom of the clip body, and wherein the two arms carry a hollow mounting shaft which extends between the two arms at a distance from the clip body, whereby the hollow mounting shaft is configured for attaching the laser device thereon and for mounting a training rod therethrough; and a ball marker device comprising a body having two sections of different vertical thickness when a bottom side of the ball marker device is placed on a horizontal surface, the two sections of different vertical thickness being a thinner section and a thicker section adjacent to the thinner section, wherein the thinner section includes one end of the ball marker device and the thicker section includes another end of the ball marker device, and wherein:

the thinner section is configured for placement of a golf ball thereon, with the thinner section having a hole extending therein, the hole configured for nesting the golf ball in place on the thinner section, whereby a putter golf club must be raised high enough to clear the thicker section during the swing motion in order to strike the golf ball placed on the thinner section, the thinner section transitions into the thicker section along an interface, and the interface comprises a curved portion whose curvature increases an extension of the thinner section relative to the thicker section, a top side of the body comprises guide markings including:

a circular placement indicator which visually indicates, in conjunction with the golf ball placed on the thinner section, when a user is in a desired putting stance, wherein the hole of the thinner section is located at a center of the circular placement indicator, and wherein, to indicate the desired putting stance, the circular placement indicator is configured such that the golf ball placed on the thinner section eclipses the circular placement indicator from a perspective of the user's non-dominant eye when the user closes his or her dominant eye in the desired putting stance, a target line indicator which visually indicates a desired putting direction of the golf ball for the swing motion, wherein the target line indicator includes portions located in both the thinner section and the thicker section, and a club face line indicator which visually indicates a desired square position of the putter golf club relative to the golf ball for the swing motion, wherein the club face line indicator is located in the thicker section and arranged perpendicular to the target line indicator, a curved notch is formed into a top side edge of the thicker section opposite the thinner section, and the thicker section is 5 mm thick, and the thinner section is 1.2 mm thick.

2. The system of claim 1, further comprising a hat mount device, the hat mount device comprising a clip and an arm extending upward from the clip, with the clip configured to attach to a brim of a hat worn by a user, and the arm positioned offset from a center of the clip, wherein the arm carries a mounting shaft which extends horizontally outward from the arm at a distance from the clip and in a direction of the center of the clip, whereby the mounting shaft is configured for attaching the mounting device of the laser device thereon.

3. A laser device for practicing a swing motion, comprising:

a housing with a laser mounted therein, the laser configured to emit a laser beam, and a mounting device configured to mount the laser device to a shaft of an object, the mounting device being rotatable 360° around the shaft of the object prior to being secured thereto, wherein the housing is rotatable 360° around an axis of the laser device relative to the mounting device, with a position indicator of the laser device having position reference markings for indicating specific positions of the housing and thus the laser relative to the mounting device.

4. The laser device of claim 3, further comprising a controller and an inertial measurement unit (IMU), the controller configured to process signals from the IMU to determine an orientation of the laser beam emitted by the laser and to turn off the laser when the orientation of the laser beam exceeds a predetermined cutoff angle above downward vertical.

5. The laser device of claim 4, wherein the predetermined cutoff angle is between 70° and 75°.

6. The laser device of claim 3, wherein the mounting device comprises a ring clamp.

7. The laser device of claim 6, wherein the ring clamp is a single pin clamp with hinged ring portions and a swing arm closure.

8. The laser device of claim 3, wherein the object is a golf club, tennis racquet or baseball bat to be swung by a user.

9. A belt mount device for practicing a swing motion, comprising:

a clip body with two attachment slots configured to receive a strap worn by a user, wherein the attachment slots fully extend through the clip body in a horizontal direction, and the attachment slots partially extend through the clip body in a vertical direction beginning from a bottom of the clip body, and two arms extending outward from the clip body which carry a hollow mounting shaft, wherein the hollow mounting shaft extends horizontally between the two arms at a distance from the clip body, whereby the hollow mounting shaft is configured for attaching a laser device thereon and for mounting a training rod therethrough.

10. A ball marker device for practicing a swing motion, comprising:

a body having two sections of different vertical thickness when a bottom side of the ball marker device is placed on a horizontal surface, the two sections of different vertical thickness being a thinner section and a thicker section adjacent to the thinner section, wherein the thinner section includes one end of the ball marker device and the thicker section includes another end of the ball marker device, wherein the thinner section is configured for placement of a golf ball thereon, with the thinner section having a hole extending therein, the hole configured for nesting the golf ball in place on the thinner section, whereby a putter golf club must be raised high enough to clear the thicker section during the swing motion in order to strike the golf ball placed on the thinner section, wherein a top side of the body comprises a target line indicator which visually indicates a desired putting direction of the golf ball for the swing motion, and the target line indicator includes portions located in both the thinner section and the thicker section, and wherein a curved notch is formed into a top side edge of the thicker section opposite the thinner section and aligned with the target line indicator, whereby the curved notch is configured to be placed adjacent the golf ball in positioning the ball marker device with the target line indicator into the desired putting direction.

11. The ball marker device of claim 10, wherein the thinner section transitions into the thicker section along an interface, and the interface comprises a curved portion whose curvature increases an extension of the thinner section relative to the thicker section.

12. The ball marker device of claim 10, wherein the top side of the body comprises additional guide markings including:

a circular placement indicator which visually indicates, in conjunction with the golf ball placed on the thinner section, when a user is in a desired putting stance, wherein the hole of the thinner section is located at a center of the circular placement indicator, and a club face line indicator which visually indicates a desired square position of the putter golf club relative to the golf ball for the swing motion, wherein the club face line indicator is located in the thicker section and arranged perpendicular to the target line indicator.

13. The ball marker device of claim 12, wherein, to indicate the desired putting stance, the circular placement indicator is configured such that the golf ball placed on the thinner section eclipses the circular placement indicator from a perspective of the user's non-dominant eye when the user closes his or her dominant eye in the desired putting stance.

14. The ball marker device of claim 10, wherein the top side of the body further comprises a circular placement indicator which visually indicates, in conjunction with the golf ball placed on the thinner section, when a user is in a desired putting stance, and wherein the hole of the thinner section is located at a center of the circular placement indicator.

15. The ball marker device of claim 14, wherein, to indicate the desired putting stance, the circular placement indicator is configured such that the golf ball placed on the thinner section eclipses the circular placement indicator from a perspective of the user's non-dominant eye when the user closes his or her dominant eye in the desired putting stance.

16. The ball marker device of claim 10, wherein the top side of the body further comprises a club face line indicator which visually indicates a desired square position of the putter golf club relative to the golf ball for the swing motion, and wherein the club face line indicator is located in the thicker section.

17. The ball marker device of claim 10, wherein the thicker section is 5 mm thick.

18. The ball marker device of claim 17, wherein the thinner section is 1.2 mm thick.

19. The ball marker device of claim 10, wherein, when viewed from above, the body has an egg shape with a narrower end and a wider end, and the thicker section is located in the narrower end.

* * * * *